US010301802B1

(12) United States Patent
Pinkerton

(10) Patent No.: US 10,301,802 B1
(45) Date of Patent: May 28, 2019

(54) ADJUSTABLE COUNTERTOP PROTECTION DEVICE

(71) Applicant: Heather Pinkerton, The Hills, TX (US)

(72) Inventor: Heather Pinkerton, The Hills, TX (US)

( * ) Notice: Subject to any disclaimer, the term of this patent is extended or adjusted under 35 U.S.C. 154(b) by 0 days.

(21) Appl. No.: 15/376,573

(22) Filed: Dec. 12, 2016

(51) Int. Cl.
*E03C 1/186* (2006.01)

(52) U.S. Cl.
CPC ..... *E03C 1/186* (2013.01)

(58) Field of Classification Search
CPC ..... E03C 1/181; E03C 1/18; A47K 13/14; A47K 13/16
See application file for complete search history.

(56) References Cited

U.S. PATENT DOCUMENTS 2,637,136 A * 5/1953 Mark ..... A63F 1/06 108/90
2,817,851 A 12/1957 Barnwell
3,176,688 A 4/1965 Tschappat
4,305,166 A 12/1981 Rose
5,815,856 A 10/1998 Dore
5,816,252 A 10/1998 Faries et al.
5,991,942 A 11/1999 Neal
6,223,362 B1 * 5/2001 Liang ..... A47K 1/06 4/245.4
6,258,455 B1 * 7/2001 Clarke ..... A01N 25/34 428/392
6,564,398 B1 5/2003 Trott
6,813,784 B1 * 11/2004 Thompson ..... A47K 13/16 4/245.1
6,959,461 B1 11/2005 Sanchez
7,685,654 B1 3/2010 Jones
7,951,292 B1 5/2011 Torre
8,088,468 B2 1/2012 Maggio
8,214,939 B2 7/2012 Spurlock
9,015,877 B2 4/2015 Litwhiler
2006/0059619 A1 3/2006 Kim et al.
2008/0201840 A1 8/2008 Hill
2010/0325791 A1 12/2010 Davidowitz
2013/0019397 A1 1/2013 May

* cited by examiner

*Primary Examiner* — Janie M Loeppke
(74) *Attorney, Agent, or Firm* — Hubbard Johnston, PLLC

(57) ABSTRACT

An article for protecting a countertop surrounding a sink is comprised of at least a top layer of absorbent material, capable of absorbing liquids, and a water-resistant layer. The article has at least three primary segments: one bottom, transverse segment, and two side segments generally arranged in a "U" shape and defining an opening between them. The width of the article is adjustable to fit sinks of different widths or diameters. To make the article narrower, a portion of the bottom, transverse segment is folded and fastened with at least one manually releasable fastener that has been previously affixed to the bottom transverse segment.

32 Claims, 8 Drawing Sheets

ADJUSTABLE COUNTERTOP PROTECTION DEVICE

FIELD OF INVENTION

The invention relates generally to a method and apparatus for protecting a countertop.

BACKGROUND

Sinks, such as those found in kitchens, bathrooms, and other spaces within the home, and in spaces within the workplace, are often mounted through an opening formed in a countertop. When the sink is used, it is not uncommon for the countertop to become wet. Furthermore, the countertop around the sink, as well as the cabinets and floor below the sink, can also become dirty from toiletries, cosmetics, dirt and grease and other liquids and materials that might be spilled by a person while using the sink. Some of these liquids and materials might stain the countertop around the sink. Furthermore, such liquids and materials can easily be transferred to clothing worn by a person using the sink.

SUMMARY

An article for protecting a countertop surrounding a sink is comprised of at least a top layer of absorbent material, capable of absorbing liquids. The article may have a water resistant layer that may also form a bottom surface and inherently possess some degree of resistance to skidding or sliding on a countertop. The bottom surface of the article may also be made skid resistant by adding an additional skid resistant coating or layer of material to the bottom surface. The article is a unitary structure or device, that includes at least three primary segments for descriptive and illustrative purposes: one bottom, transverse segment, one right side segment and one left side segment, that are generally arranged in a "U" shape and define an opening between them. The edges of the segments may be straight or curved. When placed on a countertop, surrounding a sink, the bottom, transverse segment extends between the edge of the countertop and sink, and each of the side segments extend from the bottom segment toward the back of the countertop along each side of the sink. The width of the article is adjustable to fit sinks of different widths, shapes or diameters. To make the article narrower, a portion of the bottom, transverse segment is folded and fastened in place with at least one fastener on the bottom transverse segment.

In another representative embodiment, three or more fastener parts are placed in a row along the bottom, transverse segment, in the direction in which a portion of the bottom segment is folded over on itself. At least one of the three or more fastener parts are of a first type, and at least two of the three or more fastener parts are of a second type complementary with the first type. Two or more fastener parts of the second type (for example, female snaps) are adjacent to each other and a fastener part of a first type (a male snap in this example) is placed in a row with the fastener parts of the second type. The fastener part of the first type is selectively attached to either of the two or more fastener parts of the second type, depending on the width to which the protector is to be adjusted. Allowing for the fold to be fastened in two or more positions allows for finer adjustment over a wider range of sink widths and shapes to be accommodated, depending on the spacing between the fastener parts.

In other representative embodiments, the article includes a top, transverse segment extending between the two side segments, for protecting the countertop behind the sink. The top segment preferably includes at least one opening for accommodating a plumbing fixture. In further examples of representative embodiments, the top segment is releasably fastened to the side segments in order to install it and, optionally, to allow for use of a top, transverse segment, with a different arrangement of openings for accommodating a plumbing fixture.

DETAILED DESCRIPTION OF EXEMPLARY EMBODIMENTS

In the following description, like numbers refer to like elements.

Figure 1:
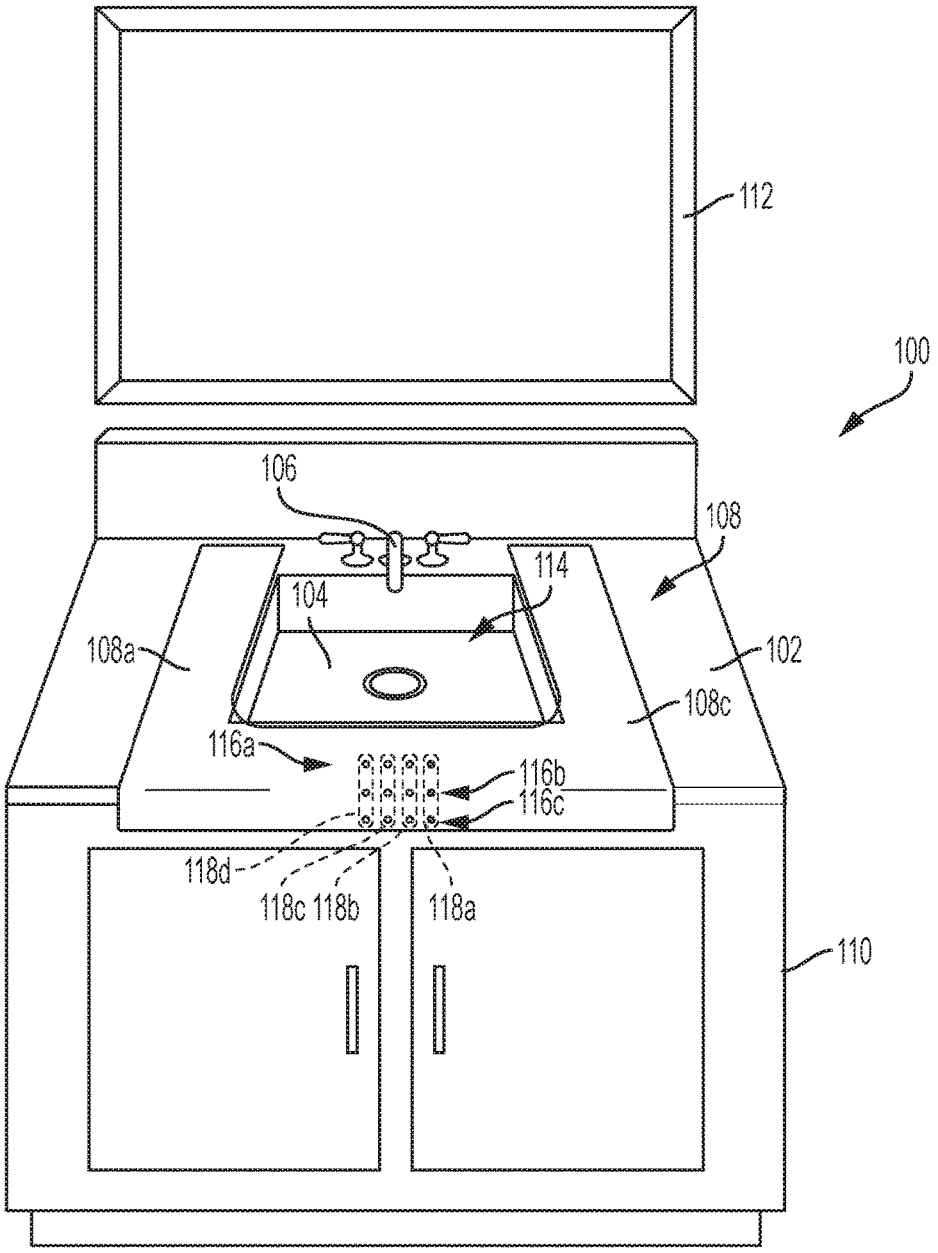
FIG. 1 is a perspective view of a vanity having a sink mounted to a countertop, showing an article for protecting the countertop, having an adjustable width, placed on a countertop around the sink.
Figure 2:
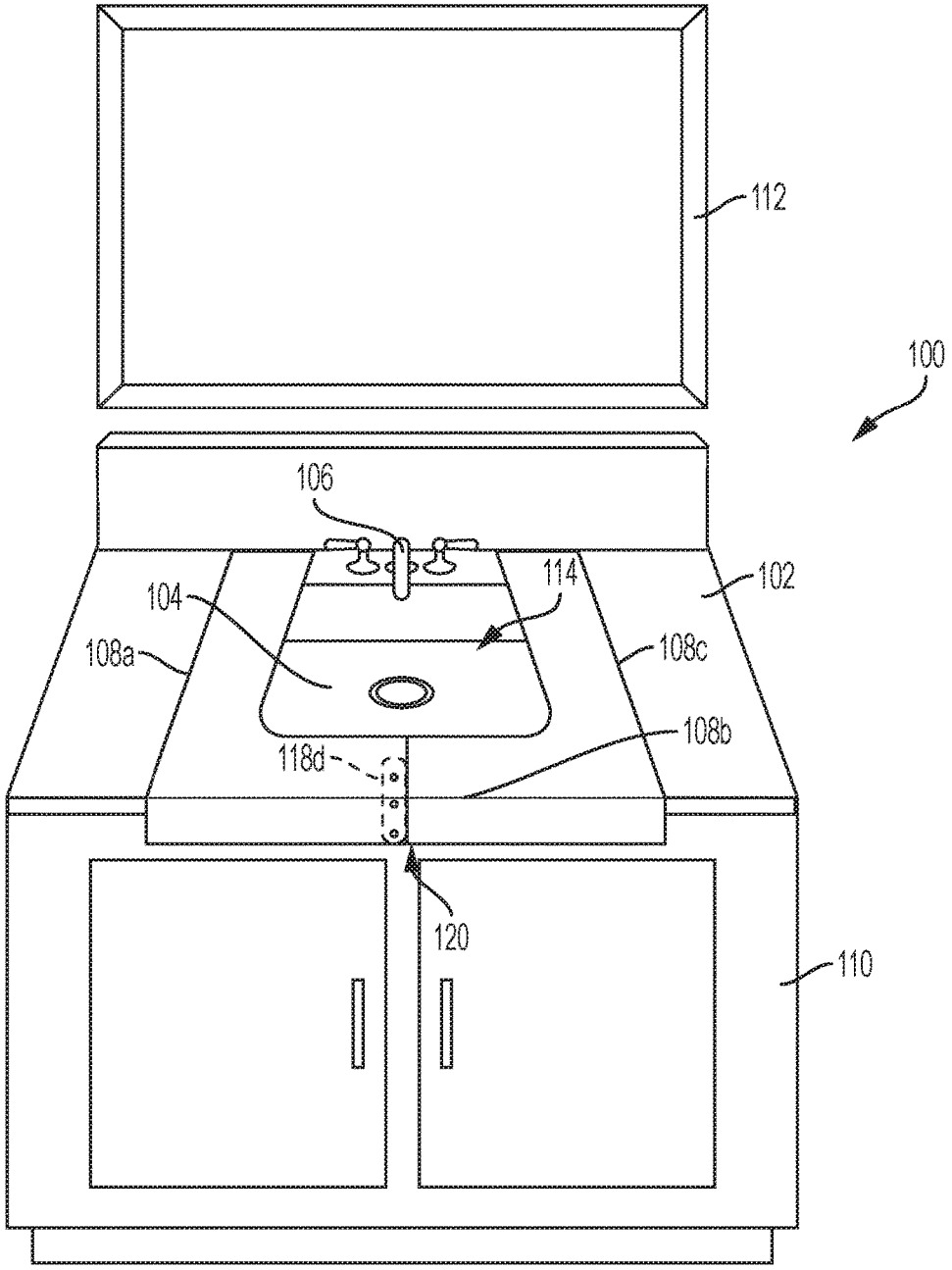
FIG. 2 is a perspective view of the vanity of FIG. 1, with the article for protecting the countertop adjusted to a narrower width.

FIGS. 1 and 2 illustrate a vanity 100 comprised of a countertop 102, a sink 104 mounted within an opening formed through the countertop, such that there is a portion of the countertop on each side of the sink, and a water faucet 106 mounted in through one or more holes formed in the countertop. The countertop is supported at or near waist height for an average person by, in this example, a cabinet 110. A mirror 112 is mounted to a wall behind the vanity.

The vanity 100 is intended to be representative of a general class of structures comprising a sink at approximately waist-height and supplied by water from a faucet in close proximity for washing hands and faces, dishes, clothing or other items while standing beside it. Such structures are typically found in various rooms or spaces throughout a residence, for example in a bathroom, kitchen, utility room, garages and basements. They are also found in the workplace, including for industrial and commercial uses. "Sink" is intended to refer to any type of sink, basin, tub or other structures intended to hold water or to channel water toward a drain. The sink will typically be surrounded at least partly by a relatively flat surface for placing items that might be used while using the sink. For example, as in FIGS. 1 and 2, the sink may be mounted on top of, or through or under an opening formed in, the countertop or similar surface. Though not shown, a sink may also be supported on a pedestal or stand and be surrounded at least partly by a relatively flat surface on which items may be placed, the surface being either integrally formed with the sink or attached to it. In the following description, unless otherwise indicated, "countertop" is intended to refer to any, relatively flat surface surrounding at least part of a sink, whether or not it is supporting the sink, or is supported by (or integrally formed with) the sink.

In the particular example of the vanity illustrated in FIGS. 1 and 2, the water faucet 106 is mounted through openings formed through the countertop 102. In this example the water faucet has two valves, each with a handle, extending through separate openings in the countertop, and a spigot extending through a third opening between the two valves. This example is referred to as a three-hole faucet. A single hole faucet typically has a single, lever-styled handle for controlling both the mixture of hot and cold water and flow rate. However, a single hole faucet may also have separate hot and cold valves mounted to the body of the faucet, or a single hot or cold water valve. The faucet may alternatively be mounted through a wall or another surface adjacent to the countertop.

Non-limiting examples of faucets to which any of the embodiments of an adjustable countertop protection device described in connection with any of the figures can be adapted for include centerset, minispread, widespread, single hole, and no handle touchless faucets for those mounted through a countertop, as well as vessel and wall mount sink faucets.

Figure 3:
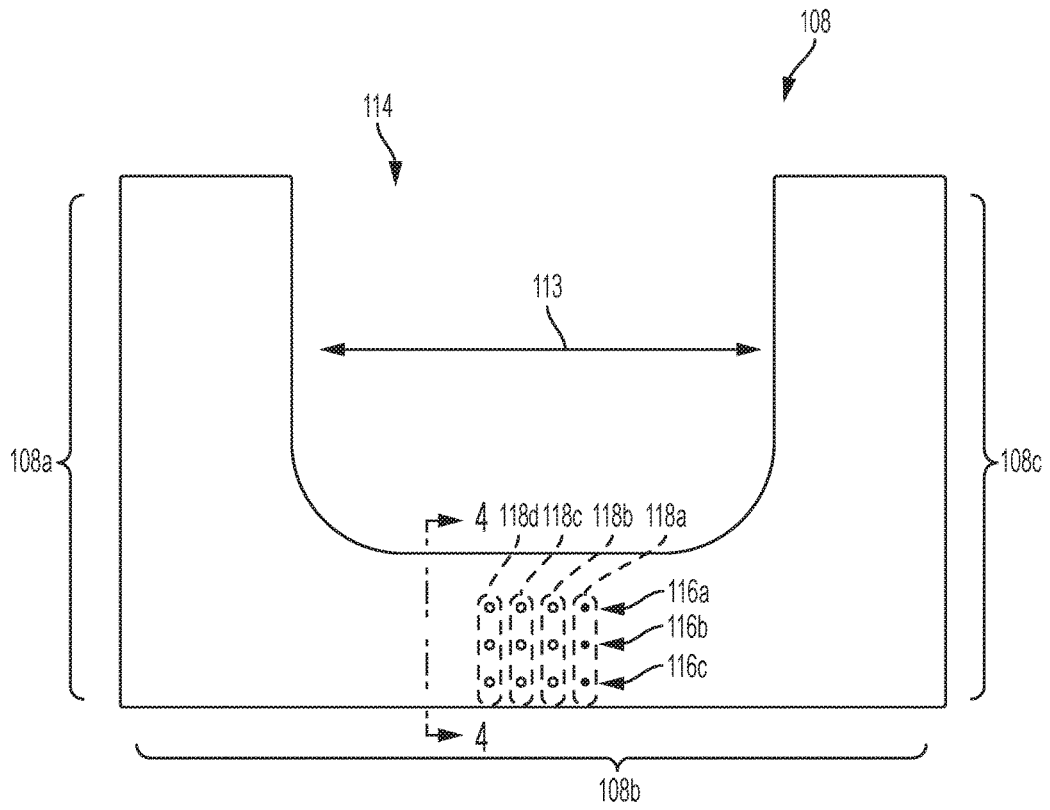
FIG. 3 is a top view of the article for protecting a countertop around the sink shown in FIGS. 1 and 2.

Laying on top of the countertop 102, surrounding the left, bottom and right sides of sink 104, is a protector 108. Referring now also to FIG. 3, protector 108 is comprised of three segments: a left side segment 108*a*, a bottom, transverse segment 108*b*, and a right side segment 108*c*. Together, the three segments form a generally "U" shape that surrounds the sink on three sides and define an opening 114 for the sink.

The countertop protector 108 has a unitary construction. It is formed into a unitary layer by, for example, cutting from a single piece of water absorbent material or by stitching, gluing or otherwise connecting together two or more pieces of material to form a unitary layer of material.

As shown in FIG. 2, the bottom, transverse segment of the protector 108 may be folded onto itself to create an "S" fold 120—when viewed from the end, the fold has a "S" or backward "S" shape—to reduce the length of the bottom, transverse segment, and thus the distance between the side segments 108*a* and 108*c* in order to make the width 113 of the opening 114 for the sink 104, formed between the side segments 108*a* and 108*c*, smaller. This width adjustment allows the protector 108 to accommodate sinks of different widths. To hold the fold in place, at least one set of complementary, manually-releasable fastener parts are affixed to the top surface of protector 108 with a predetermined lateral spacing. Non-limiting examples of releasable two-part fasteners include snap (with male and female parts), hook and loop (for example, VELCRO®), hook and eye, button (with a button hole or slit formed through the protector, or with a loop attached to the surface of the protector), adhesive, adhesive fastener, and zipper. Each two-part fastener is comprised of two complementary fastener parts that can be manually fastened together and separated. Each complementary part can be separately affixed to the protector using a suitable method, non-limiting examples of which include being sewn, glued, or otherwise attached. For example, each male and female snap is typically (but not necessarily) attached by riveting it to the fabric, with a punch and die set specific to the type of snaps used. Snaps can also be attached via sewing or plying with snap pliers. Each male snap will therefore have two pieces, one of which will for this purpose be disposed on opposite sides of the fabric to which it is attached. In the following description, when a fastener part, for example a male snap, is said to be disposed on a particular surface of a piece of fabric, it means that the piece of the fastener part that functions to engage with the other fastener part is disposed on that surface. The fasteners are, preferably, low profile. In order to allow adjustment between more than two widths, a set of complementary fastener parts may include a fastener part of a first type and at least two fastener parts of a second type that are spaced apart. The fastener part of the first type is releasably attachable to the fastener part of the second type. The fastener part of the first type is connected to one of the two fastener parts of the second type, depending on the desired amount to shorten the bottom, transverse segment 108*b* to narrow the size of the opening 114. More than one set of fastener parts may be disposed on the protector in parallel, as shown in the various examples illustrated by the FIGS. 1 to 10. However, a single set of fastener parts could be used in each of the examples.

In the illustrated embodiments of FIGS. 1, 2 and 3, a set of complementary fastener parts comprise at least one male snap and at least one female snap. Each set of snaps are arranged in a row extending in a transverse direction to the bottom segment, with the snaps displaced laterally from each other at a predetermined distance or interval. In the illustrated example there are three sets of fastener parts 116*a*, 116*b*, and 116*c*. Each set comprises a male snap 118*a* (a fastener part of a first type) and three female snaps 118*b*, 118*c*, and 118*d* (fastener parts of a second type) arranged in a row that extends laterally on the bottom, transverse section 108*b*. Although one fastener set could be used, having two or more sets is preferred for maintaining a neat fold. The fastener parts of each given type are aligned, so that the fastener parts of the first type—the male snaps in the illustrated example—form a single column that is perpendicular to each of the rows comprising a set of fastener parts. Similarly, the fastener parts of the second type are arranged in three columns. Thus, in the illustrated example, the first female snaps 118*b* in each of the sets are aligned in a first column of female snaps corresponding to a first fold position. The second female snaps 118*c* in each of the sets are arranged in a column and correspond to a second fold position. And, the third female snaps 118*d* in each of the sets are arranged in a column corresponding to a third fold position. Thus, each of the female snaps in each set corresponds to one of three fold positions, each of which results in a progressively narrower opening width 113.

FIGS. 1 and 3 shows the protector 108 in an unfolded position. FIG. 2 shows the bottom, transverse segment 108*b* folded to establish a fold 120. In this illustration, the fold is in the second of three possible fold positions, and held in place by snapping the column of male snaps 118*a* to the second column of female snaps 118*c*. The column of female snaps 118*d* remains visible. The column of female snaps 118*b* is obscured by the fold.

Figure 4:
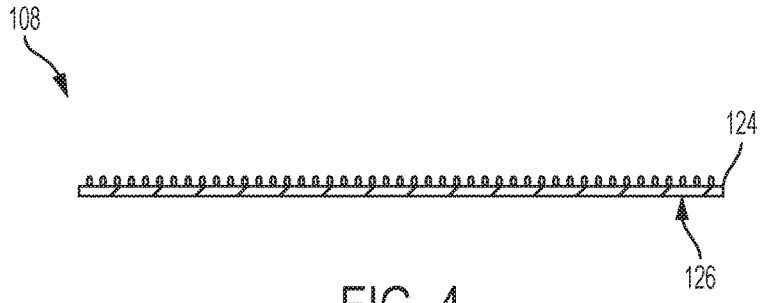
FIG. 4 is a cross-section taken along section line 4-4 in FIG. 3.

As shown in FIG. 4, which is a cross-section of protector 108 taken along section line 4-4 in FIG. 3, protector 108 is comprised of at least a top layer made of a water absorbent material 124. The protector also, preferably, includes a substantially water resistant or waterproof layer. In this description, references to "water resistant" layers are intended to include also layers that are substantially waterproof. For example, the water-resistant layer may form the bottom surface of the protector 126. Alternatively, the protector may have one or more intermediate layers, one of which may be a water resistant layer. The protector may, optionally, have a skid-resistant bottom surface formed by a bottom layer of skid-resistant material, or by skid-resistant coating applied to the bottom layer of, for example, water resistant material. The protector may, optionally, include additional layers. In a preferred embodiment, all of the layers are bound together to form a protector of unitary construction that is flexible and, preferably also, able to withstand machine washing and, optionally, also machine drying.

The water absorbent material may comprise, for example, a pile woven from threads of natural or synthetic fiber (including microfiber), or a combination of them, to form a fabric or cloth. It may include other materials, or be treated with materials, to improve strength, elasticity, absorbency and/or durability. The material may also be treated with auxiliaries and/or finishes, including but not limited to quick dry and anti-microbial. Examples of such material include terry cloth, microfiber and similar fabrics.

In the illustrated example, the layer of water absorbent material 124 is fabricated from microfiber, weaved with pile on the top side, and flat on the back side. A thermoplastic polyurethane (TPU) film is then bonded, for example by laminating or coating it, onto the flat back side of the material. The TPU film forms a water resistant layer. Although the TPU layer is somewhat resistant to skidding when placed on a countertop, a non-skid coating may also be applied to the TPU layer, to enhance the skid-resistant property of the bottom surface 126 of the protector. Alternatively, although not shown, structures for adding skid resistance may, optionally, be placed in or on more discrete locations or uniformly distributed on the bottom layer, non-limiting examples of which include suction cups. Although not shown in FIG. 4, the top ½ of loops on a top side of the pile may be sheared to create a velour-like surface. Other cross-sectional constructions could also be used, including the use of additional layers. Any one of the foregoing constructions may be used for any of the embodiments described herein, including those of FIGS. 5-10.

FIGS. 5-10 represent alternative embodiments of an adjustable countertop protection device.

Figure 5:
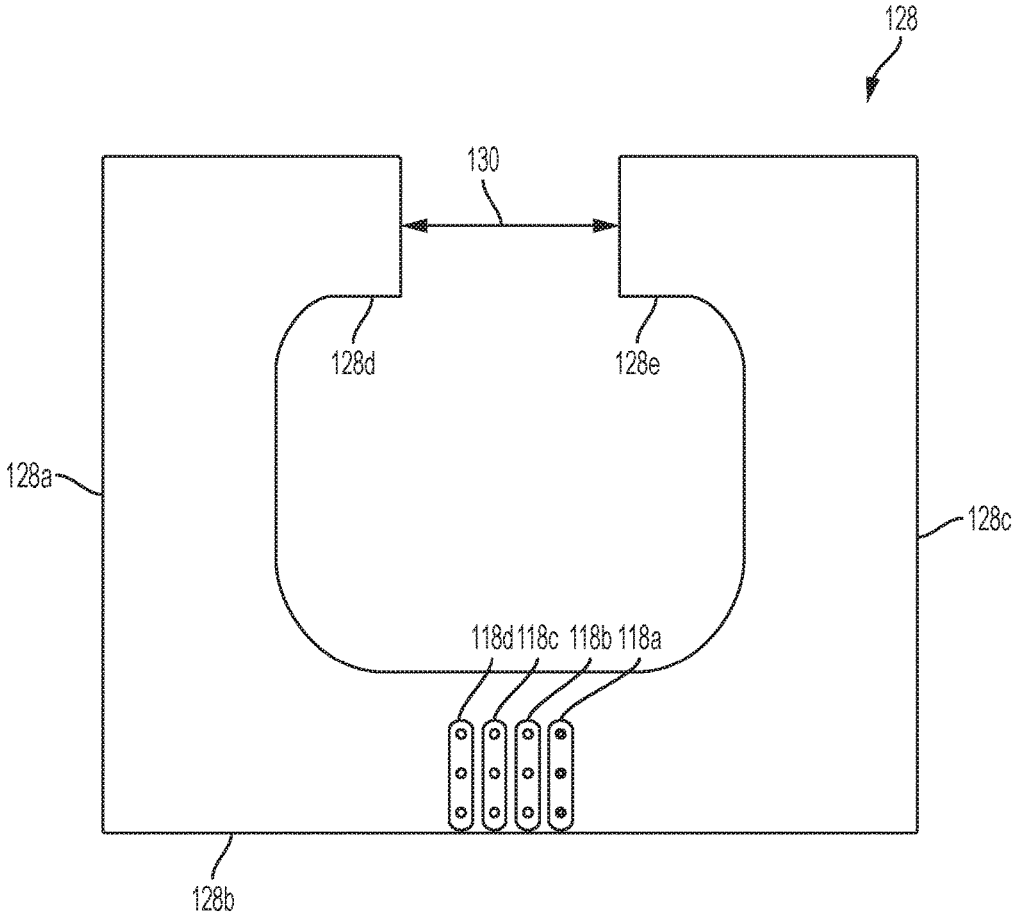
FIG. 5 is a top view of a second embodiment of an article for protecting the countertop around a sink.

In FIG. 5, countertop protector 128 is, like protector 108, comprised of three segments: a left side segment 128*a*; a bottom, transverse segment 128*b*; and a right side segment 128*c*. Also, like protector 108, it has at least one fastener to hold a fold of the bottom, transverse segment in at least one position. In this example, the countertop protector 128 has a column of male snaps 118*a*, and three columns of female snaps 118*b*, 118*c*, and 118*d* to hold the fold in one of three, progressively narrowing positions. However, unlike protector 108, it includes top segments 128*d* and 128*e* that extend inwardly to protect a portion of the countertop adjacent to the faucet, while still leaving an opening 130 for accommodating a faucet.

Figure 6:
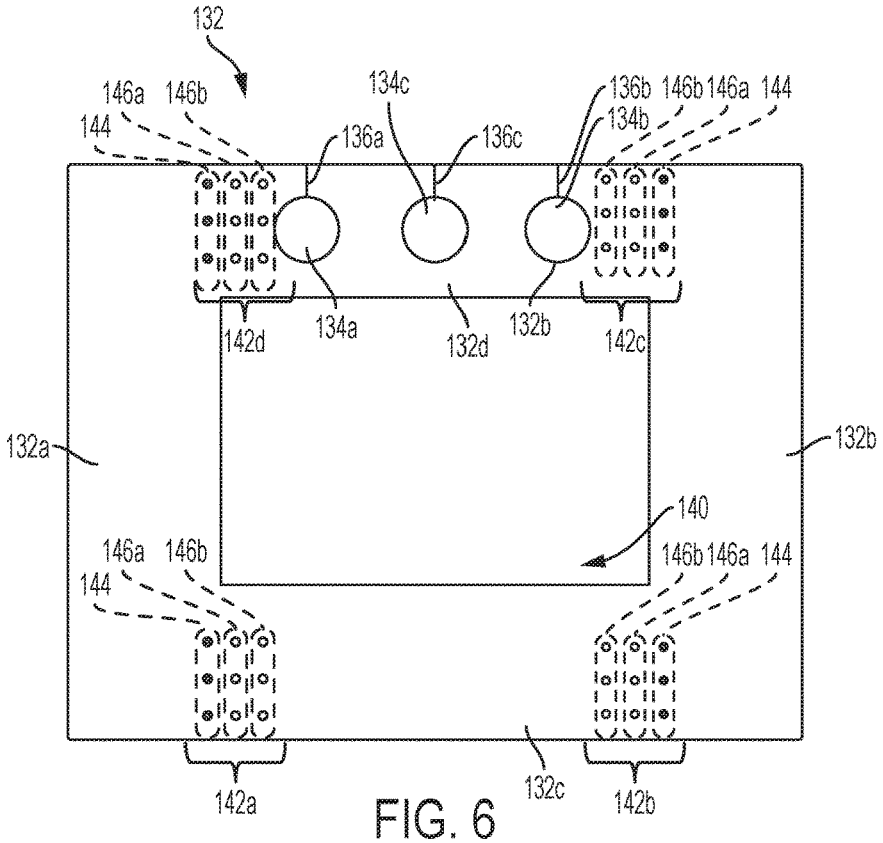
FIG. 6 is a top view of a third embodiment of an article for protecting the countertop around a sink having adjustable bottom and top segments.
Figure 7:
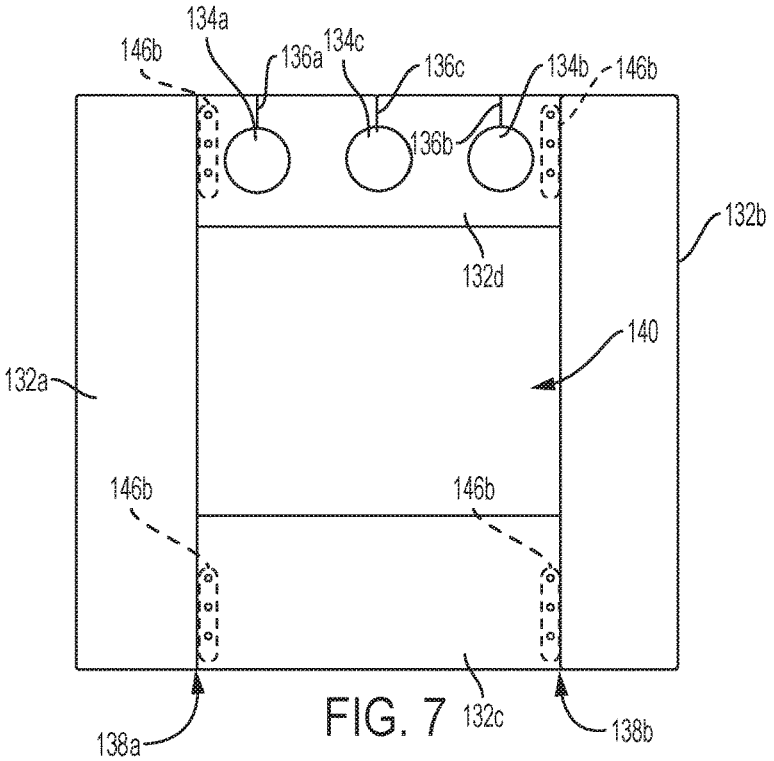
FIG. 7 is a top view of the third embodiment of an article for protecting the countertop around the sink shown in FIG. 6 adjusted to a narrower width.

FIGS. 6 and 7 illustrate yet another embodiment of an adjustable countertop protection device 132 that is constructed to allow it to cover almost entirely the countertop around a sink while still accommodating a faucet. In this example, protector 132 has four primary segments: left and right side segments 132*a* and 132*b*; a bottom, transverse segment 132*c*; and a top, transverse segment 132*d*. The top, transverse segment has a least one opening to accommodate a sink faucet. In this example, it has three openings: left and right openings 134*a* and 134*b* accommodate handles for hot and cold valves (not shown) and the center opening 134*c* accommodates a water spout (not shown). Alternatively, the protector can be made of a single opening for sinks that have a single hole faucet. An optional slit, one for each opening, allows the top, transverse segment 132*d* to be more easily installed around the faucet, given the different sizes and configurations of faucets that exist. In this example, slits 136*a*, 136*b*, and 136*c* allow the protector to be placed around each of the valves and spout. The protector has a top, water absorbent layer of unitary construction. It may also have a water resistant layer that may form a bottom layer of the protector. Or, it may also include a layer of another type of material that forms the bottom surface of the protector and provides skid-resistance. As with the other embodiment disclosed here, the adjustable countertop protection device may be cut from a single piece of material, but it may also be fabricated from multiple pieces of water absorbent material joined together by, for example, stitches, glue or other methods of joining them.

As shown in FIG. 7, the adjustable countertop protection device 132 can be adjusted by folding the top and bottom, transverse segments 132*c* and 132*d* to form two "s" folds 138*a* and 138*b* on opposite sides of opening 140. A plurality of sets of complementary fastener parts are located on the top surface of the water absorbent top layer of the countertop protector that hold the folds in place. The plurality of complementary sets of complementary fastener parts in the illustrated example are divided into four groups: 142*a*, 142*b*, 142*c* and 142*d* located, respectively, on the left and right ends of the bottom, transverse segment 132*c*, and the right and left ends of the top, transverse segment 132*d*. Each group includes at least one set of complementary fasteners. In this example, there are three sets in each group. Each set in each of the groups includes one fastener part 144 of a first type and two fastener parts 146*a* and 146*b* of a second type. In the illustrated example, the fastener that is used is a snap. The fastener part of the first type is a male snap and the fastener part of the second type is a female snap. Other two-part fastener systems, including those mentioned previously, can be substituted for the male and female snaps. Each set of complementary fastener parts holds one of the folds in one of two positions, corresponding to columns 146*a* and 146*b*. In FIG. 7, the folds 138*a* and 138*b* are secured in the first of two possible positions, with fastener parts of a first type 144 being connected with fastener parts of a second type 146*a*, and the second column of fastener parts of a second type 146*b* remaining visible. In this particular example, the fold is intended to be made toward the left. However, the adjustable countertop protection device can be made so that the fold is made in the other direction by reversing the positions of the complementary fastener parts.

Figure 8:
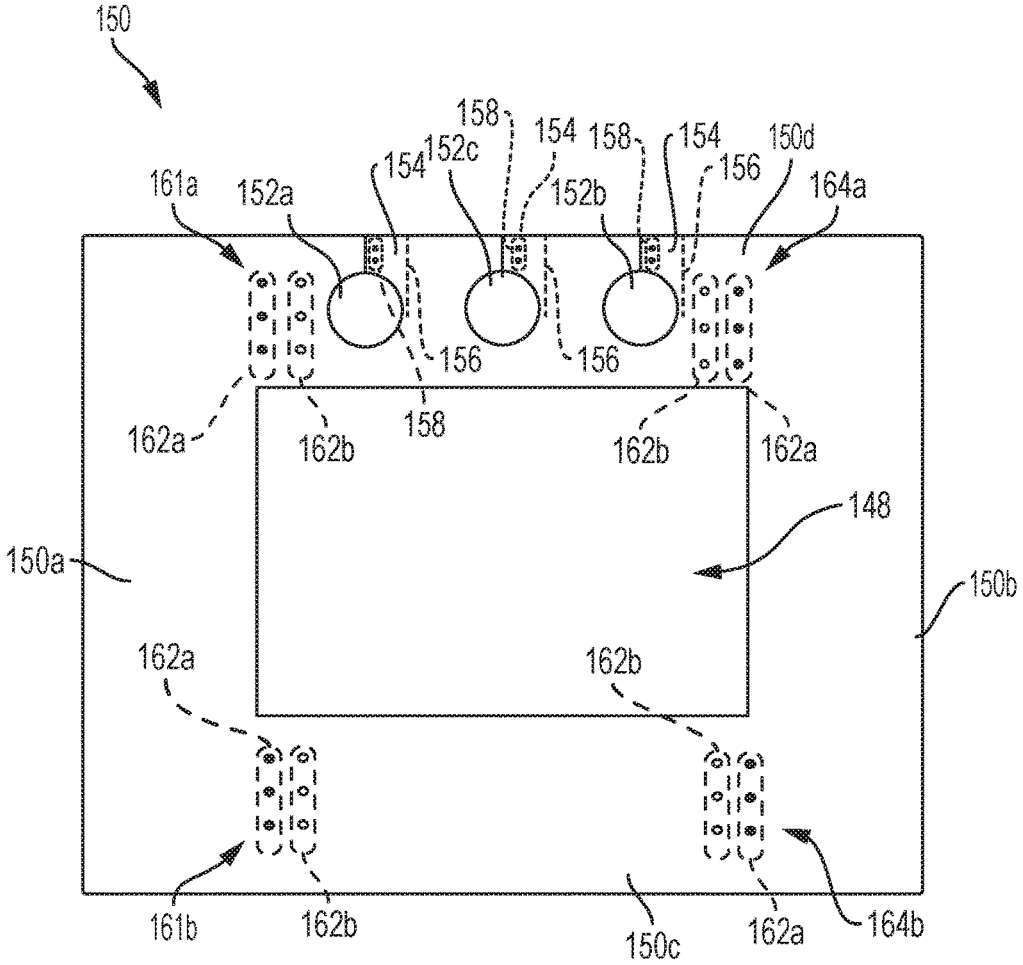
FIG. 8 is a top view of a fourth embodiment of the article for protecting the countertop around the sink.

Referring now to FIG. 8, countertop protector 150 represents another, alternative embodiment of an adjustable counter protection device that is similar to the embodiment of FIGS. 6 and 7 in several respects, but differs in the construction of the openings for accommodating faucets. Like the embodiment of FIGS. 6 and 7, it is constructed to allow it to cover almost entirely the countertop around a sink while still accommodating a faucet. In this example, protector 150 has four primary segments surrounding a central opening 148 for the sink: left side and right side segments 150*a* and 150*b*; a bottom, transverse segment 150*c*; and a top, transverse segment 150*d*. All four segments are formed into a single, unitary protector in this example.

The top, transverse segment has a least one opening to accommodate a sink faucet. In this example, it has three openings for accommodating a faucet: left and right openings 152*a* and 152*b* accommodate handles for hot and cold valves (not shown) and the center opening 152*c* accommodates a water spout (not shown). Alternatively, the protector can be made with a single opening for a single hole faucet. Like the embodiment of FIGS. 6 and 7, the top, transverse segment between each of the openings 152*a*-152*c* and a top edge of the segment can be opened to allow the top, transverse segment to be wrapped around the faucet handles. This allows the protector to more easily fit around the faucet during installation, while protecting the counter on the backside of a faucet (opposite the sink). However, unlike the slit of the embodiment of FIGS. 6 and 7 for accommodating the faucet as the protector 150 is installed, protector 150 employs overlapping flaps on the back side of the faucet to close the opening and ensure that the countertop is properly protected. The overlapping flaps are referenced by numbers 154 and 156 on the figures. Flap 154 is on top and flap 156, the edge of which is indicated by a dashed line, is underneath flap 154. They are, optionally, fastened by a two part fastener 158, which has complementary pairs of releasable fastener parts, which are indicated in phantom because they cannot be seen in the top view shown in the figure. One of each pair of complementary fastener parts is located on the top flap, with its engaging surface disposed on the bottom side of the top flap, and the other complementary fastener part being attached to the bottom flap, with its engaging surface located on the top side of the bottom flap. Non-limiting examples of types of manually releasable fasteners include male and female snap, hook and loop, and hook and eye, button (with a button hole or slit formed through the protector, or with a loop attached to the surface of the protector), adhesive, adhesive fastener, and zipper.

The width of the protector can be made adjustable in a manner similar to the manner in which the protectors of FIGS. 1-7 are made adjustable. The left and right sides of the protector can be folded inwardly, toward the sink, and held in place by at least one complementary pair of fastener parts on each side of the sink. In the illustrated example of FIG. 8, six pairs of complementary fastener parts are used for each side: a group of three pairs of complementary fastener parts 161*a* on the top left of the protector; a group of three complementary pairs of fastener parts 161*b* on the bottom left of the protector; a group of three pairs of complementary fastener parts 164*a* on the top right and a group of three pairs of complementary fastener parts 164*b* on the bottom right. Although each group of complementary fastener parts is shown to have three complimentary pairs, a greater number or fewer number of pairs could be used. The fastener parts of the same type on the top and bottom of each side are generally aligned so that a neat fold can be made on each side. Each complementary pair of fastener parts is comprised of a fastener of a first type, a representative example of which is male snap 162*a*, and a fastener of a second type, represented by female snap 162*b*. If additional fold positions are desired, additional fastener parts of the second type, for example, can be added to form, instead of a pair of complementary fastener parts, a set of complementary fastener parts, in a manner similar to that shown in FIGS. 6 and 7. As previously mentioned, different types of two part fasteners can be substituted for the male and female snaps shown in any of the figures.

Figure 9:
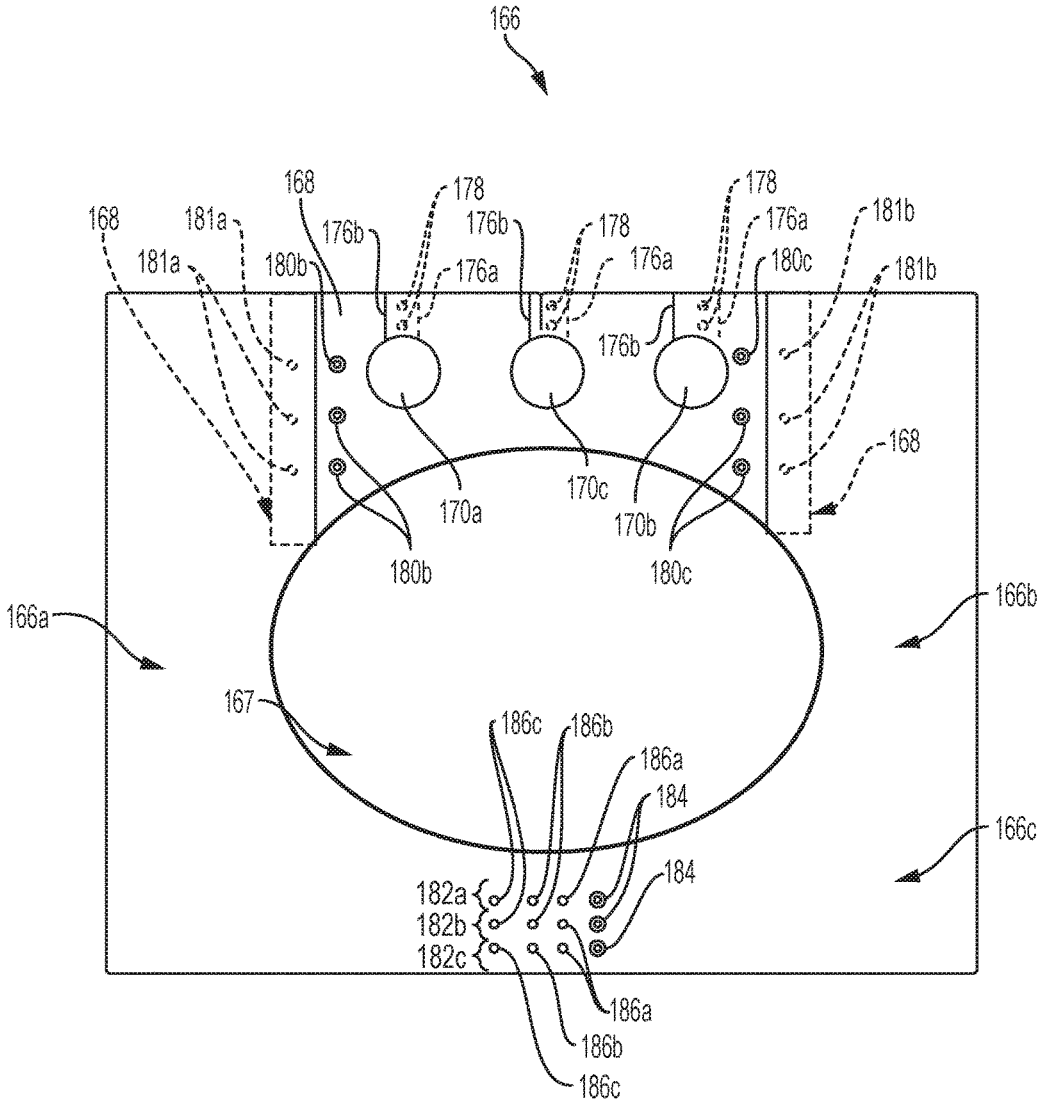
FIG. 9 is a top view of a fifth embodiment of an article for protecting the countertop around a sink having a removable or interchangeable top, transverse segment.
Figure 10A:
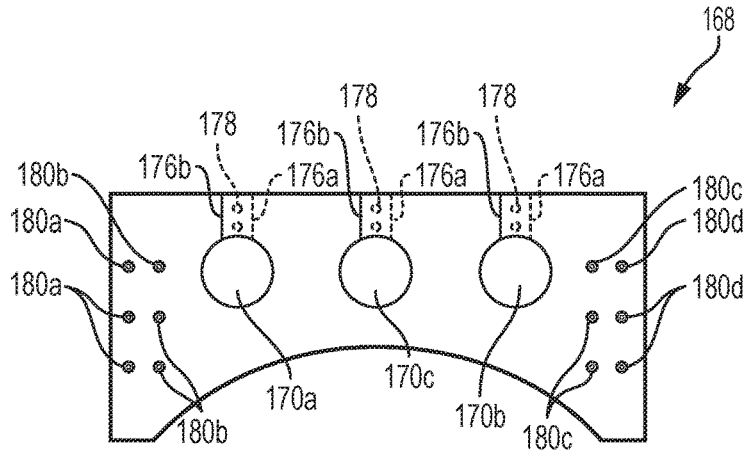
FIG. 10A is a top view of an interchangeable top, transverse segment for the article of FIG. 9, with openings for plumbing fixtures.
Figure 10B:
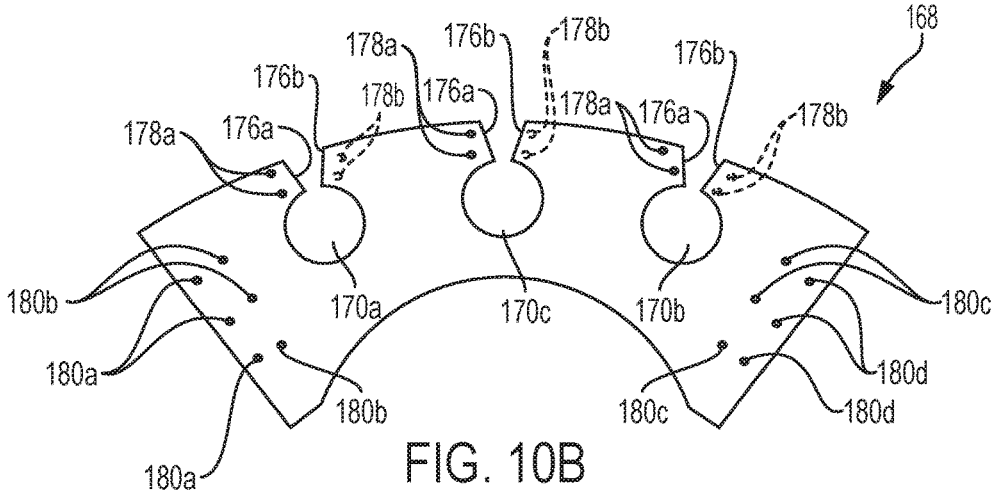
FIG. 10B is a top view of the interchangeable top, transverse segment of FIG. 10A, with slots opened to allow fixtures to be slid into openings formed in the segment.
Figure 10C:
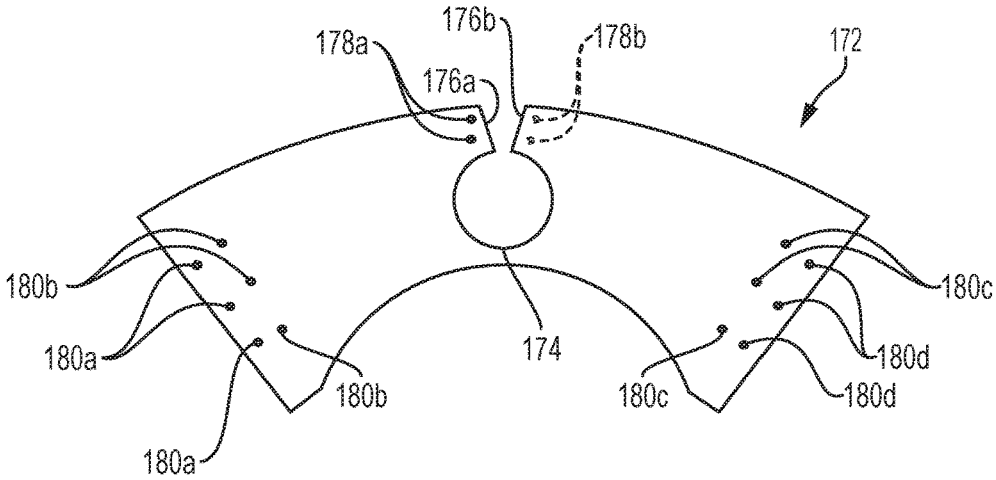
FIG. 10C is a top view of a second interchangeable top, transverse segment for the article of FIG. 9, with a single opening for a plumbing fixture.

Referring now to FIGS. 9 and 10A-10C, another alternative embodiment is represented by the example protector 166. It has left and right side segments 166*a* and 166*b* and a bottom, transverse segment 166*c* flanking an opening 167 that, when the protector is installed, is aligned with a sink. In addition, it has a separate top, transverse segment 168 that is releasably connected between the left and right side segments using, on one side of each segment, at least one two-part fastener that is manually fastenable and unfastentable. FIGS. 10A and 10B illustrate the top, transverse segment 168, with faucet openings 170*a*, 170*b*, and 170*c* in closed and open positions, respectively. FIG. 10C illustrates a top, transverse segment 172 with a single opening 174 for a single-hole faucet. Top, transverse segments 168 and 172 are interchangeable. The protector 166 and the top, transverse segments could be sold separately. Or, the protector could be sold with just one or a set of top, transverse segments designed to fit different types and arrangements of faucets. The top, transverse segment could also be customized based on a customer's specifications. The number of openings, and the size and placement of each opening could be specified.

With continued reference to FIGS. 10A to 10C, in a manner similar to that shown in FIG. 8, each of the openings 170*a*, 170*b*, 170*c*, and 174 employ overlapping flaps on the back side of the faucet to close a slit that extends between the openings and an edge of the top transverse segment to ensure that the countertop is properly protected. Note that the slit extends to the top edge in this example, but it could also be made to extend to the lower edge. The overlapping flaps are referenced by numbers 176*a* and 176*b*. Flap 176*b* is the top flap, and flap 176*a* is the bottom flap, the edge of which is indicated by a dashed line in FIG. 10A. The flaps are, optionally, fastened together by complementary pairs of releasable fasteners 178, which are indicated in phantom in FIG. 10A because they cannot be seen. One of each pair of complementary fastener parts is located on the top flap, with its engaging surface disposed on the bottom side of the top flap, and the other complementary fastener part being attached to the bottom flap, with its engaging surface located on the top side of the bottom flap. The flaps and locations of fasteners can be, in alternative embodiments, reversed from what is shown in the drawings. Non-limiting examples of types of manually releasable fasteners include male and female snap, hook and loop, hook and eye, button (with a button hole or slit formed through the protector, or with a loop attached to the surface of the protector), adhesive, adhesive fastener and zipper. In the illustrated example, two pairs of complementary fasteners are shown for each pair of overlapping flaps, namely two male snaps 178*a* and two female snaps 178*b* (shown in phantom because they are on the underside of the flaps).

The top, transverse segments 168 and 172 are attached to the left and right side segments using at least one complementary pair of fasteners on each end. In this example, three complementary pairs of male and female snaps are used. In FIGS. 10A-10C, two columns of fasteners of a first type 180*a* and 180*b*, with three in each column, are located on the left end of the top, transverse segments 168 and 172, and two columns of fasteners of a first type 180*c* and 180*d* are located on the right end of the top, transverse segments 168 and 172. Multiple columns will, as explained below, provide adjustability. A corresponding column of complementary fasteners of a second type 181*a*, shown in phantom in FIG. 9 because they are located on the underside of the protector, are located on the left side segment 166*a*, and can selectively connect with either column of fasteners of a first type 180*a* or 180*b*, depending on the desired distance between the side segments and size of opening 167, and to connect or fasten the left side of the top, transverse segment 168 or 172 to the left side segment 166*a*. Similarly, a corresponding column of fasteners of a second type 181*b*, which are complementary with the first type and shown in phantom because they are located on the underside of the right side segment 166*b*, can selectively mate with either column of fasteners of a first type 180*c* or 180*d*. The side segments overlap with the top, transverse segment in this example, but, in an alternative embodiment, could be reversed, and the locations of the complementary fasteners could also be reversed. In the illustrated embodiment of FIGS. 10A to 10C, the fasteners used for connecting the top, transverse segments 168 or 172 to the protector are male snaps for the first type and female fasteners for the second type. However, other types of fasteners can be used. It is not required that these fasteners be of the same type as the fasteners used on other parts of the protector to provide adjustability.

To make the width of the opening 167 of the protector adjustable, the left and right side segments 166*a* and 166*b* can be moved inwardly, toward the sink, by folding the bottom, transverse segment between the left and right side segments. Shown in the drawings is the opening 167 at its widest, without a fold. A fold is made by folding over at least one fastener part of a first type located on the top surface of the bottom, transverse segment toward a complementary fastener part of a second type that is displaced laterally from the fastener part of the first type. In this example three sets 182*a*, 182*b*, and 182*c* of complementary fasteners are used instead of one. As with also the examples shown in FIGS. 1-7, any number of fasteners can be used, depending on the depth of the bottom segment and materials being used for the protector. Each set of complementary fastener parts forms a row, with the fastener parts in the sets organized in columns by type and fold position. In this example, there is one column of fastener parts 184 of a first type and three columns 186*a*, 186*b*, and 186*c* of fastener parts of a second type positioned for holding a fold made to the left. However, the positions of the two types of fastener parts can be reversed in alternative embodiments if the preference is for holding a fold made to the right. In this embodiment, as with all of the other embodiments described above, one, two or more than three columns could be used. The three columns of fastener parts 186*a*, 186*b* and 186*c* allow progressively larger folds to be made and held in place to narrow the opening 167, with column 186*c* corresponding to the largest fold and, thus, the smallest size for opening 167. In this illustration, male snaps are used for fastener parts of the first type and female snaps are used for the fastener parts of the second type. However, fasteners other than snaps can be used. As the opening 167 is narrowed by folding the bottom, transverse segment 166*c*, the column of fastener parts selected for connecting the left and right of the top, transverse segment to the side segments can be changed. Referring to FIG. 9, for example, the column 181*a* of fastener parts of a second type, which are indicated as being in phantom because they are disposed on the underside of the flap that extends over transverse segment 168, are shown connected to column 180*a* of fastener parts of the first type, which are obscured in this view by the flap and thus cannot be seen. In addition, the column 181*b* of fastener parts of the second type, also shown in phantom because they are disposed on the underside of the flap that extends over the transverse segment 168, are connected to the column 180*d* of fastener parts of the first type, which are obscured in this view by the flap and cannot be seen.

The embodiments of FIGS. 5 to 10 have, optionally, cross-sectional constructions similar to that shown in FIG. 4. Other cross-sectional constructions could also be used, including the use of additional layers. Each of these embodiments is of unitary construction. It may be cut, for example, from a single piece of water-absorbent material. However, the top layer of the protector, and any of its other layers, may also be constructed of multiple pieces that are connected by, for example, being sewn, glued or otherwise joined, preferably in a permanent manner.

In each of the examples of FIGS. 1 to 10, the openings in the adjustable countertop protection device for accommodating the sink could be made with different shapes, depending on the shape of the types of sinks with which the protector is intended to be used. The inside edges of each of the segments that define the opening in the device could be straight or curved to accommodate a sink of a particular shape, such as a round, oval, rectangular (including square), semi-circle, or other shape. In the example of FIGS. 1 to 3, the three segments of the protector form a "U" shape, which has the advantage of better fitting the shapes of a greater range of common sinks. The left, right and bottom segments generally have straight side edges. However, one or more of the inside edges could, instead, be curved, or possess a curvature. Additionally, the protector can be made with square corners where the segments join, which is not shown. As shown, the transitions between the inside edges of the left and bottom segments begin to curve as they approach each other thereby forming rounded corners. Similarly, the inside edges of the bottom and right segments also curve toward each other, thereby forming a rounded corner. In an alternative embodiment, the inside edges of all the segments could form a continuous curve.

Although the arrangements shown in the illustrated embodiments may offer advantages or be preferred, it may be possible to alter some of the features shown without departing from the subject matter, at least in regard to some of the claims. For example, in each of these embodiments, the surfaces and the positions to which fastener parts are attached can be reversed. For example, in alternative embodiments, fastener parts shown attached to the top surface of the adjustable countertop protection device can be placed on the bottom surface, and the relative positions of complementary fastener parts from left to right can be reversed, in order to accommodate different folding patterns, such as left, right, on top, or under. For fasteners that are attached with components on opposite sides of the device, such as riveted snaps, references to the side of the device to which the fastener part is attached or located should be interpreted in the forgoing description as referring to the side on which the portion of the fastener part that will engage with a complementary fastener part is located. Furthermore, fastener parts could be positioned to hold folds made in the middle, or to one side, of the bottom transverse segment, or folds on the side segments. Furthermore, when one piece of material is shown overlapping another piece, such as flaps 176*a* and 176*b* in FIGS. 10A-10B, or side segments 166*a* and 166*b* overlapping the separate top transverse segment 168, the overlap and associated fastener parts can be reversed.

The foregoing description is of exemplary and preferred embodiments. The invention, as defined by the appended claims, is not limited to the described embodiments. Alterations and modifications to the disclosed embodiments may be made without departing from the invention. The meaning of the terms used in this specification are, unless expressly stated otherwise, intended to have ordinary and customary meaning and are not intended to be limited to the details of the illustrated or described structures or embodiments.

What is claimed is:

1. An apparatus for protecting a countertop surrounding a sink, comprising:

a first side segment;

a second side segment; and a bottom, transverse segment extending between the first and the second side segments, thereby spacing the first and second side segments from each other and forming an opening between them for accommodating the sink;

wherein each of the first side segment, the second side segment, and the bottom, transverse segment, has a top surface formed by a water-absorbent material, and a bottom surface formed by a water resistant material;

wherein the apparatus further comprises at least one set of two or more complementary fastener parts, that are capable of being manually coupled and uncoupled to each other, one of which is a fastener part of a first type and one of which is a fastener part of a second type, the at least two, complementary fastener parts being affixed to the bottom, transverse segment for engagement on either the top or bottom surface of the bottom transverse segment a predetermined distance apart that allows the fastener part of the first type and the fastener part of the second type to be coupled together to hold a fold in the bottom, transverse segment to narrow the opening between the first and second side segments; and wherein the first and second side segments and the bottom transverse segment have a unitary construction.

2. The apparatus of claim 1, wherein the first side segment, the second side segment, and the bottom, transverse segment are comprised of a single piece of water absorbent material, or of multiple pieces of material sewed together as one.

3. The apparatus of claim 1, wherein the water absorbent material is comprised of a fabric.

4. The apparatus of claim 1, wherein the apparatus is comprised of a layer of fabric with—a pile on one side that forms the top surface of the apparatus and a flat surface on an opposite side, and wherein the water resistant material is comprised of a film layer that is bonded to the flat surface.

5. The apparatus of claim 4, wherein, the fabric is a microfiber with pile on the top side, with a flat back for receiving the film; and the film is a thermoplastic polyurethane film that is laminated or coated onto the flat back side of the fabric.

6. The apparatus of claim 1, wherein the apparatus comprises a bottom surface formed by a water-resistant layer, to which is applied a coating, layer, or material that creates resistance to skidding when the apparatus is placed on a countertop.

7. The apparatus of claim 1, further comprising a top, transverse segment extending between the first and second side segments.

8. The apparatus of claim 7, wherein the top, transverse segment is a separate piece that is fastened to each of the first and second side segments by at least one set of complementary fastener parts that are capable of being manually coupled and uncoupled.

9. The apparatus of claim 8, wherein the at least one set of complementary fastener parts for fastening the top, transverse segment to the first side segment is comprised of a fastener part of a first type located on one side of the top transverse segment and the first side segment and a fastener part of a second type located on the other side of the top transverse segment and the second side segment.

10. The apparatus of claim 7, wherein the top transverse segment has at least one opening formed therein for accommodating a sink fixture.

11. The apparatus of claim 10, wherein the apparatus has at least one slit connecting the opening with an edge of the top transverse segment for facilitating fitting the top transverse segment around a sink fixture.

12. The apparatus of claim 10, wherein the top transverse segment further comprises a flap for closing the slit.

13. The apparatus of claim 12, further comprising at least one set of complementary fastener parts for selectively fastening the flap.

14. The apparatus of claim 1, wherein the two or more complementary fastener parts comprise at least one fastener part of a first type and a plurality of fastener parts of a second type, the fastener parts of a second type being complementary with the fastener part of the first type; and the fastener parts of a first and second types being arranged in a transverse row, with the fastener part of the first type at one end of the row, whereby the fold is capable of being held in a plurality of different positions corresponding to each of the plurality of fastener parts of the second type.

15. The apparatus of claim 1, wherein the at least one set of two or more complementary fastener parts that are capable of being can be manually coupled and uncoupled comprises a first and a second set of two or more complementary fastener parts that are capable of being manually coupled and uncoupled, the first set and the second set being laterally displaced with respect to each other for supporting two folds of the bottom transverse segment.

16. The apparatus of claim 1, wherein the at least two complimentary fastener parts comprise at least two complementary fastener parts chosen from a set consisting of male and female snap, hook and loop, and hook and eye, button and a button hole, slit or loop, adhesive, adhesive fastener, and zipper.

17. An adjustable counter protection device for protecting a countertop surrounding a sink, comprising:

a first side segment;

a second side segment; and a bottom, transverse segment extending between the first and the second side segments, thereby spacing the first and second side segments from each other and forming an opening between them for accommodating the sink;

wherein the first and second side segments and the bottom, transverse segment have a unitary construction;

wherein each of the first side segment, the second side segment, and the bottom, transverse segment, has a top surface formed by a water-absorbent washable fabric, and a bottom surface formed by a water resistant layer; and wherein the apparatus further comprises at least one set of three or more complementary fastener parts, one of which is a fastener part of a first type and two of which are fastener parts of a second type that are capable of being manually coupled and uncoupled to each other, the at least three, complementary fastener parts being affixed to the bottom transverse segment a predetermined distance apart that allows the fastener part of the first type and the fastener part of the second type to be coupled together to hold a fold in the bottom, transverse segment to narrow the opening between the first and second side segments in either of two positions.

18. The adjustable counter protection device of claim 17, wherein the first side segment, the second side segment, and the bottom, transverse segment are comprised of a single, unitary piece of water absorbent washable fabric.

19. The adjustable counter protection device of claim 17, wherein the washable fabric has a pile on one side that forms the top surface of the adjustable counter protection device, and a flat surface on an opposite side, to which is bonded a film that comprises the water resistant layer.

20. The adjustable counter protection device of claim 19, wherein, the fabric is a microfiber with pile on the top side and a flat back for receiving the film; and the film is a thermoplastic polyurethane film that is laminated or coated onto the flat back side of the fabric.

21. The adjustable counter protection device of claim 17, wherein the apparatus comprises a bottom surface formed by a water-resistant layer to which a material that creates resistance to skidding when the apparatus is placed on a countertop is applied.

22. The adjustable counter protection device of claim 17 further comprising a top, transverse segment extending between the first and second side segments.

23. An adjustable counter protection device for protecting a countertop surrounding a sink, comprising:

a first side segment, a second side segment, and a bottom, transverse segment extending between the first and the second side segments, thereby spacing the first and second side segments from each other; and a top, transverse segment extending between the first and the second side segments, thereby forming an opening defined horizontally between the first and second side segments, and vertically between the bottom, transverse segment and the top, transverse segment, for accommodating the sink;

wherein, the top, transverse segment having formed therein at least one opening for accommodating a fixture;

wherein at least the first and second side segments and the bottom, transverse segment have a unitary construction;

wherein each of the first side segment, the second side segment, and the bottom, transverse segment, has a top surface formed by a water-absorbent washable fabric, and a bottom surface formed by a water resistant layer;

wherein the adjustable counter protection device further comprises at least one set of two or more complementary fastener parts that are capable of being manually coupled and uncoupled, one of which is a fastener part of a first type and one of which is a fastener part of a second type, the at least two, complementary fastener parts being affixed to the bottom, transverse segment for engagement on either the top or bottom surface of the bottom transverse segment a predetermined distance apart that allows the fastener part of the first type and the fastener part of the second type to be coupled together to hold a fold in the bottom, transverse segment to narrow the opening between the first and second side segments.

24. The adjustable counter protection device of claim 23, wherein the top, transverse segment is removably fastened to each of the first and the second side segments.

25. The adjustable counter protection device of claim 24, further comprising a substitute top, transverse segment for replacing the top, transverse segment to accommodate a different fixture.

26. The adjustable counter protection device of claim 23, wherein the first and second side segments, the bottom, transverse segment, and the top, transverse segment have a unitary construction.

27. An adjustable counter protection device for protecting a countertop surrounding a sink, comprising:

a first side segment, a second side segment, and a bottom, transverse segment extending between the first and the second side segments, thereby spacing the first and second side segments from each other; and a top, transverse segment extending between the first and the second side segments, thereby forming an opening defined horizontally between the first and second side segments, and vertically between the bottom, transverse segment and the top, transverse segment, for accommodating the sink;

wherein, the top, transverse segment having formed therein at least one opening for accommodating a fixture;

wherein at least the first and second side segments and the bottom, transverse segment have a unitary construction;

wherein each of the first side segment, the second side segment, and the bottom, transverse segment, has a top surface formed by a water-absorbent material, and a bottom surface formed by a water resistant layer;

wherein the adjustable counter protection device further comprises at least one set of two or more complementary fastener parts that are capable of being can be manually coupled and uncoupled, one of which is a fastener part of a first type and one of which is a fastener part of a second type, the at least two, complementary fastener parts being affixed to the bottom, transverse segment for engagement on either the top or bottom surface of the bottom transverse segment a predetermined distance apart for holding a fold in the bottom, transverse segment to narrow the opening between the first and second side segments;

wherein the at least two fasteners include at least one fastener part of a first type and at least two fastener parts of a second type affixed to the bottom transverse segment a predetermined distance apart for holding a fold in the bottom, transverse segment to narrow the opening between the first and second side segments in either of two positions; and wherein the top, transverse segment has a left end and a right end removably fastened to the first and second side segments, respectively, by a first set of complementary fastener parts and a second set of complementary fastener parts; the first set of complementary fastener parts comprising at least two fastener parts of a first type located on the left end of the top, transverse segment, and at least one fastener part of a second type located on one side of the top of the first side segment; and the second set of complementary fastener parts comprising at least two fastener parts of a first type located on the right end of the top, transverse segment, and at least one fastener part of a second type located on one side of the top of the second side segment; wherein, in each of the first and the second sets of complementary fastener parts, the at least two fastener parts of the first type are spaced apart for changing where the top, transverse segment is fastened to the first and second side segments to accommodate the fold in the bottom, transverse segment.

28. The apparatus of claim 27, wherein the water absorbent material is comprised of a fabric.

29. An adjustable counter protection device for protecting a countertop surrounding a sink, comprising:

a first side segment, a second side segment, and a bottom, transverse segment extending between the first and the second side segments, thereby spacing the first and second side segments from each other; and a top, transverse segment extending between the first and the second side segments, thereby forming an opening defined horizontally between the first and second side segments, and vertically between the bottom, transverse segment and the top, transverse segment, for accommodating the sink;

wherein, the top, transverse segment has formed therein at least one opening for accommodating a fixture;

wherein each of the first side segment, the second side segment, and the bottom, transverse segment, has a top surface formed by a water-absorbent washable fabric, and a bottom surface formed by a water resistant layer;

wherein the adjustable counter protection device further comprises at least a first set of two or more complementary fastener parts capable of connecting together a first end of the top, transverse and the first side segment at either of two different positions, and at least a second set of two or more complementary fastener parts capable of connecting together a second end of the top, transverse segment and the second side segment at either of two different positions.

30. The adjustable counter protection device for protecting a countertop surrounding a sink of claim 29, wherein each of the first and the second sets of complementary fastener parts include at least one fastener part of a first type and at least two fastener parts of a second type, the at least one fastener part of the first type being capable of being connected to any one of the at least two fastener parts of the second type to change a relative positions of the top transverse side segments and the first and second side the side segments when connected together.

31. The adjustable counter protection device of claim 30, wherein the at least one opening is comprised of an elongated slot.

32. The adjustable counter protection device for protecting a countertop surrounding a sink of claim 29, wherein the first set of complementary fastener parts comprises at least two fastener parts of a first type located on the first end of the top, transverse segment and at least one fastener part of a second type located on one side of a top surface of the first side segment; and the second set of complementary fastener parts comprising at least two fastener parts of a first type located on the right end of the top, transverse segment, and at least one fastener part of a second type located on one side of a top surface of the second side segment; wherein, in each of the first and the second sets of complementary fastener parts, the at least two fastener parts of the first type are spaced apart for changing where the top, transverse segment is fastened to the first and second side segments.

* * * * *